US005085716A

United States Patent [19]

Fuerst et al.

[11] Patent Number: 5,085,716

[45] Date of Patent: Feb. 4, 1992

[54] HOT WORKED RARE EARTH-IRON-CARBON MAGNETS

[75] Inventors: Carlton D. Fuerst, Royal Oak; Earl G. Brewer, Warren, both of Mich.

[73] Assignee: General Motors Corporation, Detroit, Mich.

[21] Appl. No.: 622,690

[22] Filed: Dec. 5, 1990

Related U.S. Application Data

[63] Continuation-in-part of Ser. No. 482,124, Feb. 20, 1990, abandoned.

[51] Int. Cl.[5] ..... H01F 1/053

[52] U.S. Cl. ..... 148/301; 148/302; 420/9; 420/13; 420/14; 420/83; 420/121; 75/236; 75/238

[58] Field of Search ..... 148/301, 302; 420/9, 420/13, 14, 83, 121; 75/236, 238

[56] References Cited

U.S. PATENT DOCUMENTS

| | | | |
|---|---|---|---|
| 4,792,367 | 12/1988 | Lee | 148/104 |
| 4,844,754 | 7/1989 | Lee | 148/302 |
| 4,849,035 | 7/1989 | Stadelmaier et al. | 148/101 |

FOREIGN PATENT DOCUMENTS

| | | | |
|---|---|---|---|
| 60-76108 | 4/1985 | Japan | 148/302 |
| 60-144906 | 7/1985 | Japan | 148/302 |
| 60-144907 | 7/1985 | Japan | 148/302 |
| 60-144908 | 7/1985 | Japan | 148/302 |
| 62-181403 | 8/1987 | Japan | 148/302 |
| 63-98105 | 4/1988 | Japan | 148/302 |

OTHER PUBLICATIONS

Buschow et al, "Note on the Formation and the Magnetic Properties of the Compound $Nd_2Fe_{14}C$", *Journal of the Less-Common Metals*, vol. 141 (1988), pp. L15–L18.

Coehoorn et al, "Permanent Magnetic Materials Based on $Nd_2Fe_{14}C$ Prepared by Melt Spinning", *Journal of Applied Physics*, vol. 65, No. 2, Jan. 15, 1989, pp. 704–709.

DeBoer et al, "Magnetic and Crystallographic Properties of Ternary Rare Earth Compounds of the Type $R_2Fe_{14}C$", *Journal of Magnetism and Magnetic Materials*, vol. 72 (1988), pp. 167–173.

DeBoer et al, "Magnetic Properties of $Nd_2Fe_{14}C$ and Some Related Pseudoternary Compounds", *Journal of Magnetism and Magnetic Materials*, vol. 73 (1988), pp. 263–266.

DeMooij et al, "Formation and Magnetic Properties of the Compounds $R_2Fe_{14}C$", *Journal of the Less-Common Metals*, vol. 142 (1988), pp. 349–357.

Denissen et al, "Spin Reorientation in $Nd_2Fe_{14}C$", *Journal of the Less-Common Metals*, vol. 142 (1988), pp. 195–202.

Gueramian et al, "Synthesis and Magnetic Properties of Ternary Carbides $R_2Fe_{14}C$ (R=Pr, Sm, Gd, Tb, Dy, Ho, Er, Tm, Lu) with $N_2Fe_{14}B$ Structure Type", *Solid State Communications*, vol. 64, No. 5 (1987), pp. 639–644.

Helmholdt et al, "Neutron Diffraction Study of the Crystallographic and Magnetic Structure of $Nd_2Fe_{14}C$", *Journal of the Less-Common Metals*, vol. 144 (1988), pp. L33–L37.

Liu et al, "High Coercivity Permanent Magnet Materials Based on Iron-Rare Earth-Carbon alloys", *Materials Letters*, vol. 4, No. 8,9, Aug. 1986, pp. 377–380.

Liu et al, "High Intrinsic Coercivities in Iron-Rare Earth-Carbon-Boron Alloys Through the Carbide or Boro-Carbide $Fe_{14}R_2X$ ($X=B_xC_{1-x}$)", *Journal of Applied Physics*, vol. 61, No. 8, Apr. 15, 1987, pp. 3574–3576.

Pedziwiatr et al, "Magnetic Properties of $R_2Fe_{14}C$ (R=Dy or Er)", *Journal of Magnetism and Magnetic Materials*, vol. 59 (1986), pp. L179–L181.

Pedziwiatr et al, "Magnetism of $R_2Fe_{14}B$-Based Systems", *Journal of the Less-Common Metals*, vol. 126 (1986), pp. 41–52.

Sanchez et al, "Structural, Mossbauer and Magnetic Studies of DyFeC(B) Permanent Magnet Alloys", *Journal of Magnetism and Magnetic Materials*, vol. 79 (1989), pp. 249–258.

*Primary Examiner*—John P. Sheehan

*Attorney, Agent, or Firm*—George A. Grove

[57] ABSTRACT

Anisotropic permanent magnets consisting essentially of $RE_2TM_{14}C$ are prepared by hot working suitable iron-neodymium/praseodymium-carbon containing alloys so as to produce deformed fine grains of the above essential magnetic phase.

3 Claims, 4 Drawing Sheets

HOT WORKED RARE EARTH-IRON-CARBON MAGNETS

This is a continuation-in-part of our co-pending application Ser. No. 482,124, filed Feb. 20, 1990, now abandoned.

This invention relates to permanent magnets based on rare earth elements and iron. More particularly, this invention relates to hot worked, fine grain permanent magnets based on iron, neodymium and/or praseodymium and carbon.

BACKGROUND OF THE INVENTION

Permanent magnets based on the $RE_2Fe_{14}B$-type structure have gained wide commercial acceptance. Such magnets can be made by a sintering practice, and they can be made by rapidly solidifying a melt of suitable composition and producing bonded magnets or hot pressed magnets or hot pressed and hot worked magnets from the quenched material.

Recently, rare earth-iron-carbon compositions have been formed in the $RE_2Fe_{14}C$ structure which is analogous to the above-mentioned iron-rare earth-boron structure. Stadelmaier and Liu, U.S. Pat. No. 4,849,035, cast iron-dysprosium-carbon compositions and iron-dysprosiumneodymium-carbon-boron compositions in the form of ingots and through a prolonged annealing cycle at 900° C. produced the magnetically hard tetragonal 2-14-1 structure. The casting displayed permanent magnet properties as did comminuted particles produced from the casting. The comminuted particles were disclosed as suitable for use in a bonded magnet. While such materials displayed appreciable coercivity, they displayed relatively low remanence.

Coehoorn et al., "Permanent Magnetic Materials Based on $Nd_2Fe_{14}C$ Prepared by Melt Spinning", *Journal of Applied Physics*, Vol. 62, No. 2, 15 January 1989, pp. 704–709, produced melt-spun ribbon particles of neodymium, iron and carbon which, when annealed at a suitable temperature, produced a permanent magnet of the 2-14-1 structure. Such particles could also be used to make a resin-bonded magnet.

It is an object of our invention to provide hot worked magnets, e.g., hot pressed or hot pressed and die upset magnets, of the $Nd_2Fe_{14}C$-type structure that have very fine grains, have permanent magnet characteristics and are magnetically anisotropic. It is another object of our invention to provide a method of making such hot worked magnets.

BRIEF SUMMARY OF THE INVENTION

In accordance with the preferred embodiment of our invention, these and other objects and advantages are accomplished as follows.

We prepare a melt comprising neodymium and/or praseodymium, iron and carbon, or carbon and boron, that is suitable, upon hot working, for forming the 2-14-1 type structure with a minor portion of one or more second phases. This molten composition is very rapidly solidified such as by melt spinning to produce an amorphous composition or a composition of very fine grain size, for example, no greater than about 40 nm in average grain size. The melt-spun material is initially in the form of friable, magnetically isotropic ribbon fragments which may be readily broken into a powder suitable for hot pressing and/or other hot working in a die cavity.

Such powder particles are amorphous or contain many very fine grains. The particles are magnetically isotropic. They are hot pressed at a suitable elevated temperature of about, e.g., 700° C. to 900° C. for a period of 20 to 30 seconds to a few minutes to form a fully dense, fine grain $Nd_2Fe_{14}C$-type tetragonal crystal structure. The hot pressed body may then be further hot worked at an elevated temperature, e.g., 750° C. to 900° C., to promote the growth of platelet-like grains and to plastically deform the body to align the platelets such that their c-axes are generally parallel and the resultant body is magnetically anisotropic. The body is still fine grained although the grains are flattened and aligned and its preferred direction of magnetization is in the direction of pressing, i.e., perpendicular to the direction of material flow during hot working. In general, we prefer that the largest average dimension of the flat grains be no more than about 1000 nm and that they be no more than 200 nm thick. The microstructure of the hot worked material is characterized by a predominance of these flattened 2-14-1 grains with one or more minor phases of intergranular material that is typically composed of iron and the rare earth element(s).

We prefer the use of iron as the transition metal element although mixtures of iron and cobalt may be employed. We prefer the use of neodymium and/or praseodymium as the rare earth element although up to 40 percent of the total rare earth content may include other rare earth elements. We prefer carbon or mixtures of carbon and boron for the third constituent of the 2-14-1 structure. In the practice of our invention, the proportions of iron (or iron and cobalt), rare earth elements and carbon must be balanced so that the predominant crystalline phase formed is the 2-14-1 tetragonal structure. If this crystal structure is not formed, the hot worked product will have low coercivity or no permanent magnetic characteristics at all.

Further objects and advantages of our invention will become apparent from a detailed description of the preferred embodiments.

In this description, reference will be had to the drawing figures in which:

FIG. 1 consists of two scanning electron microscope (SEM) photographs [FIG. 1(*a*) and FIG. 1(*b*)] from the fracture surface of a die upset $Nd_{13.75}Fe_{80.25}C_6$ magnet. The press direction lies vertically in the photographs. Two magnifications of the same region are provided.

FIG. 2 consists of three graphs of process parameters measured during the hot pressing of melt-spun ribbons with the composition $Nd_{16}Fe_{78}C_9$.

FIG. 3 consists of three graphs of process parameters measured during the die upsetting of a hot pressed precursor with the composition $Nd_{16}Fe_{78}C_9$.

FIG. 4 consists of demagnetization curves for hot pressed and die upset magnets. The compositions are indicated in each panel.

DETAILED DESCRIPTION

Figure 1A:
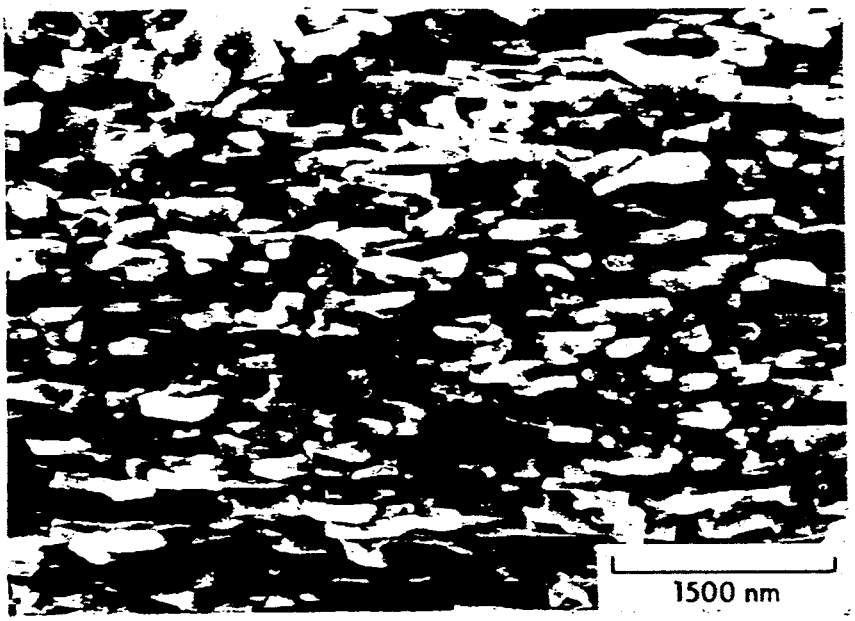

The product of our practice is a permanent magnet. It has a coercivity greater than 1000 Oersteds.

EXAMPLE 1

We prepared an ingot whose composition on an atomic percent basis was neodymium, 13.75 percent; iron, 80.25 percent; and carbon, 6 percent. This material was remelted by induction melting in a quartz crucible under argon atmosphere at a superatmospheric pressure of 1–3 psi and melt spun by ejecting the molten material through a 0.65 mm orifice at the bottom of the crucible onto the perimeter of a 10 inch diameter chromium-plated copper wheel rotating at a speed of 28 meters per second. The ejected molten stream was instantaneously quenched as it hit the rim of the spinning wheel and thrown off as ribbon fragments.

An X-ray diffraction analysis of the ribbon particles confirmed that they were substantially amorphous. The ribbon fragments were crushed to powder to facilitate handling. A portion was then placed in the cavity of a 0.5 inch diameter graphite die. They were preheated therein in vacuum to 450° C. The die temperature was then rapidly increased to 750° C. When the die temperature exceeded 640° C., pressure was applied by boron nitride-lubricated tungsten carbide-titanium carbide punches. A pressure cycle was initiated, causing the load to ramp to a maximum load of 100 MPa. The load was held at maximum load for 30 seconds to ensure full compaction before the punches were withdrawn and the sample ejected. The entire process was done in a vacuum. A fully densified cylindrical body was formed.

The resulting hot pressed body had a density of about 7.74 g/cc and contained the $Nd_2Fe_{14}C$ tetragonal crystal phase with small amounts of intergranular phases of uncertain composition believed to be largely neodymium and iron. The lattice parameters of this tetragonal phase were determined to be a=8.797 angstroms and c=12.001 angstroms.

The magnetic properties of this hot pressed body were derived from a demagnetization curve measured with a hysteresisgraph. The body displayed magnetic anisotropy. The relevant properties in the direction parallel to pressing were as follows: $B_r$=7.7 kG, $H_{ci}$=10.7 kOe and $(BH)_{max}$=11.4 MGOe. In the direction perpendicular to pressing, the magnetic properties were: $B_r$=6.8 kG, $H_{ci}$=11.3 kOe and $(BH)_{max}$=8.1 MGOe.

EXAMPLE 2

A hot pressed cylinder from Example 1 was pressed a second time in the same direction in vacuum using an oversized (0.75 inch ID) graphite die that permitted the magnet to plastically deform the magnet at a die temperature of 750° C. to 800° C. to about 40 percent of its original height. The resulting die upset, flat cylindrical magnet was sectioned with a high speed diamond saw to produce a 2 mm cube for measurement of its magnetic properties in a vibrating sample magnetometer. The cube was cut so that two opposite faces were perpendicular to the direction of pressing and die upsetting, and the other four faces were parallel to the direction of pressing and die upsetting.

The demagnetization curves for the neodymium-iron-carbon die upset magnet revealed a higher remanence in the press direction ($B_r$=12.3 kG) than in the direction perpendicular the press direction where $B_r$=1.7 kG. This magnetic anisotropy is indicative of the alignment of the c-axis of the individual die upset grains along the press direction. The coercivity of the sample in the press direction was 2.8 kOe.

Figure 1B:
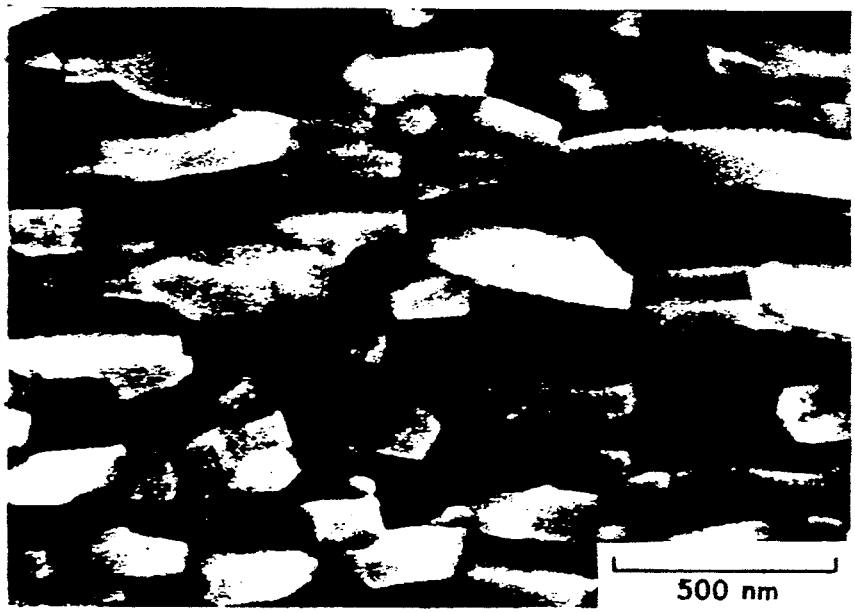

FIGS. 1(*a*) and 1(*b*) are two SEM photographs at different magnifications of the same region of a fracture surface of this die upset specimen. The grains of the $Nd_2Fe_{14}B$ tetragonal crystals are seen to be aligned flat platelets. The grains are about 100 nm thick and up to about 700 to 800 nm in their largest dimension. The short dimension of the grains, the c-axis, the preferred direction of magnetization lies along the direction of applied stress.

EXAMPLE 3

A family of four alloys was prepared so as to be composed as follows: $Nd_{13.75}Fe_{80.25}(B_{1-x}C_x)_6$ where x in the four samples was respectively 0.2, 0.4, 0.6 and 0.8.

The several samples were individually melt spun to form amorphous ribbon fragments as in Example 1. The four lots of ribbon fragments were pulverized and hot pressed into cylindrical bodies in accordance with the practice of Example 1. They contain fine grains of the tetragonal phase $Nd_2Fe_{14}C_xB_{1-x}$ where the values of x were as indicated above. The densities and the magnetic properties of the cylindrical magnetic bodies were as follows:

| | Density (g/cc) | $B_r$ (kG) | $H_{ci}$ (kOe) | $(BH)_{max}$ (MGOe) |
|---|---|---|---|---|
| 0.2 | 7.38 | 8.2 | 14.5 | 14.3 |
| 0.4 | 7.39 | 8.2 | 14.0 | 14.4 |
| 0.6 | 7.20 | 8.1 | 13.6 | 14.2 |
| 0.8 | 7.35 | 8.2 | 12.9 | 14.5 |

EXAMPLE 4

The relatively low coercivity and high resistance to deformation of our die upset $Nd_{13.75}Fe_{80.25}C_6$ magnets suggested to us the need for higher neodymium concentrations. Several alloys were prepared as described in Example 1 using the formula $Nd_{13.75+x}Fe_{80.25-x}C_6$. The several respective compositions were melt spun as described in Example 1 except that a wheel speed of 30 m/s was used. The samples were hot pressed and most were die upset. These hot working steps were carried out using graphite dies and tungsten carbide-titanium carbide punches also as described in Example 1.

Figure 2:
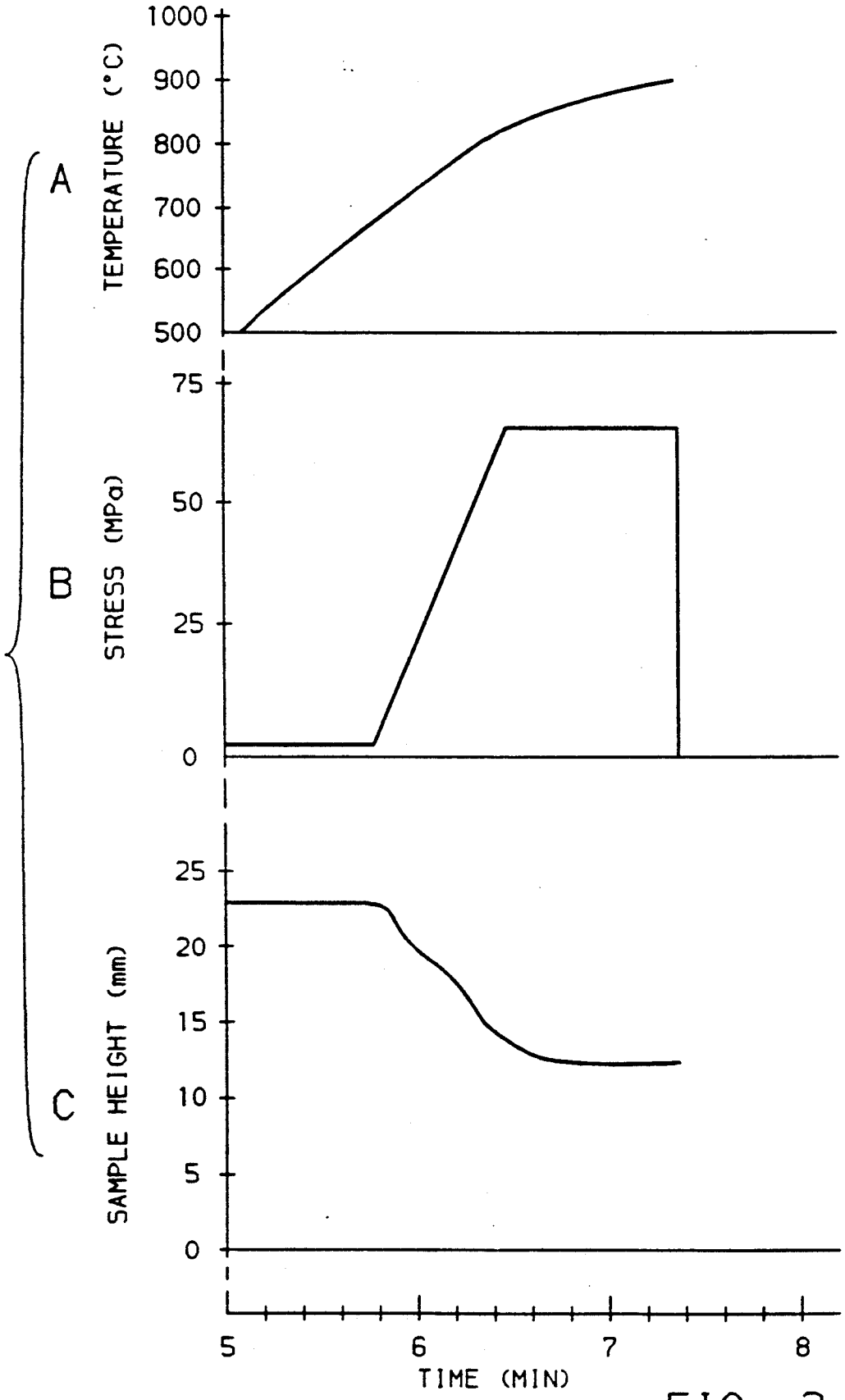

Typical process parameters used for hot pressing these Nd-Fe-C ribbons are shown in FIG. 2. The ribbons were heated to 650° C. in about 5.75 minutes, at which point the pressure was applied (see panels A and B of FIG. 2). The time interval required to reach full (or nearly full) density was between 1 and 2 minutes at maximum pressure (about 65 MPa), as the lower two panels in FIG. 2 show. The final hot press temperature was around 850° C. for the hot pressed carbide magnets, compared to about 800° C. for Nd-Fe-B magnets.

The hot pressed magnets were removed from the die and cooled to room temperature. Magnetic measurements were then made as described below. The data is reported in Table I below. Some of the hot pressed magnets were then reheated and die upset in a larger die as described in Example 2.

Figure 3:
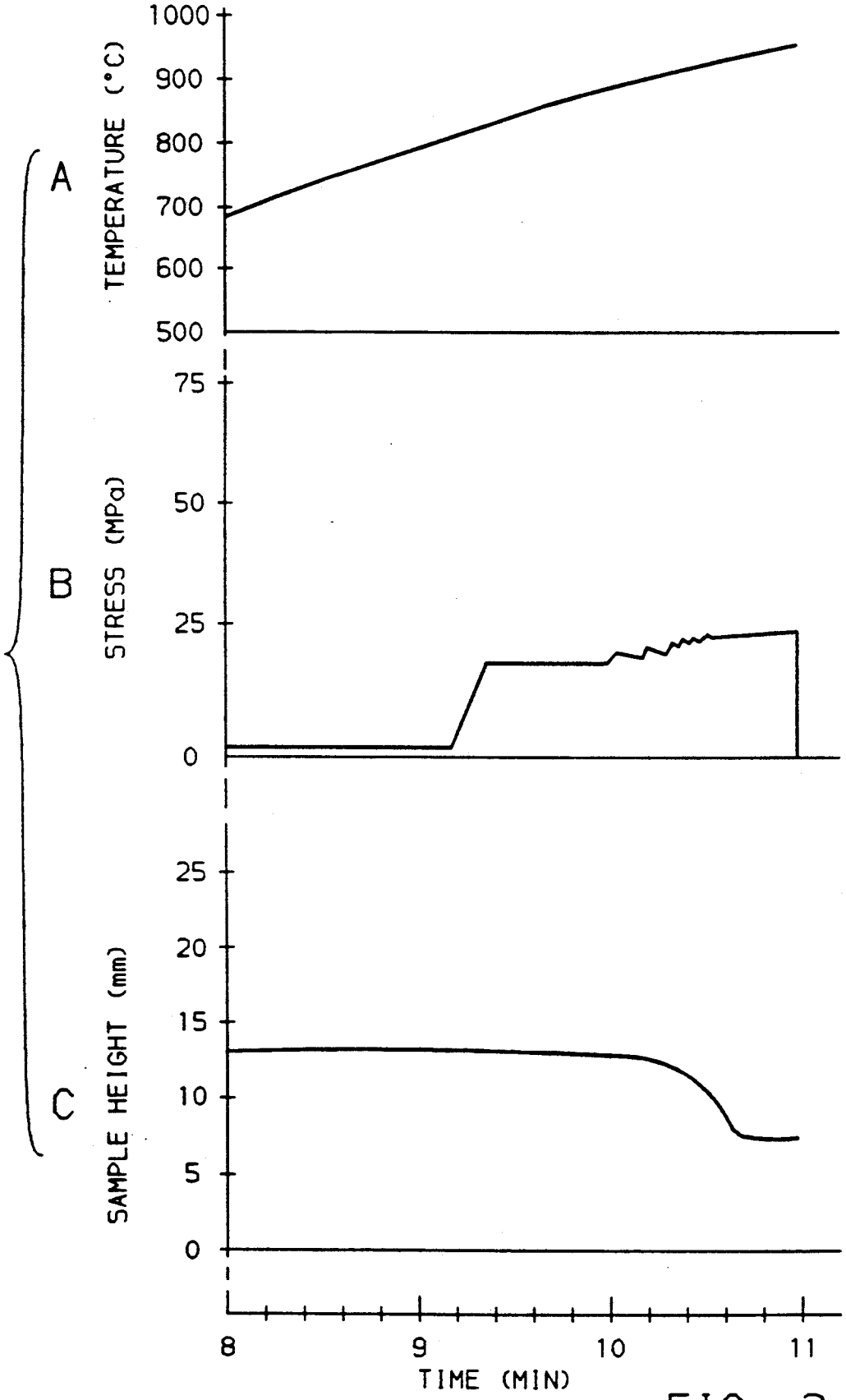

The temperature reached 700° C. in about 8.25 minutes of heating. An initial die upsetting pressure of about 15 MPa was applied at about 800° C. (see FIG. 3). This pressure was maintained until the sample height had decreased at least about 5 percent, at which point the pressure was increased to 20 to 25 MPa. Starting with 15 MPa ensured that deformation could be induced without cracking the precursor; however, the strain rate at 15 MPa was too slow. Increasing the pressure to 20 to 25 MPa enhanced the strain rate to levels comparable to those observed for Nd-Fe-B alloys (about 1 $min^{-1}$). Higher temperatures were required to produce fully die upset carbide magnets; the final temperature (about 900° C.) was 50 to 100 degrees higher than that used for die upsetting boride magnets. All die upset magnets discussed here were reduced to 45 percent of their original height (i.e., 55 percent die upset).

Magnetic measurements of the hot pressed and die upset magnets were made using a Walker Model MH-5020 hysteresisgraph; the results are summarized in Tables I and II. X-ray (Cu $K_\alpha$) diffraction patterns were obtained for powdered ribbons after annealing for about 30 minutes at 700° C.

Surprisingly, at neodymium concentrations above 14.5 atomic percent with the carbon concentration at 6 atomic percent, the coercivity of the hot pressed magnets decreased sharply compared to similar boride compositions. The coercivity apparently vanishes altogether at $Nd_{16}Fe_{78}C_6$ due to the formation of the phase $Nd_2Fe_{17}$. The major diffraction peaks are easily accounted for when compared to the calculated pattern for the 2-17 phase. It is quite possible that the observed 2-17 phase contained dissolved carbon, as reported by others studying annealed ingots.

To suppress the formation of the 2-17 phase, higher concentrations of carbon were tried using the composition formula $Nd_{16}Fe_{78-y}C_{6+y}$. With increasing carbon levels, the coercivity of hot pressed magnets increased sharply, exceeding 12 kOe for concentrations at or above 9 percent. Powder X-ray diffraction patterns for annealed $Nd_{16}Fe_{75}C_9$ ribbons revealed strong intensities from the tetragonal 2-14-1 phase with lattice parameters of a=0.8803 nm and c=1.2010 nm. Comparing the observed reflections to the calculated pattern for $Nd_2Fe_{14}C$ confirmed that the 2-14-1 phase was the major phase, but it was still by no means the only phase present. In addition to the possibility of small amounts of 2-17, the presence of elemental iron ($\alpha$-Fe) was also indicated.

The presence of phases such as $\alpha$-Fe and 2-17 in these alloys was made more apparent by adjusting the neodymium concentration while maintaining high carbon levels of 9 percent and 10 percent. Increasing the neodymium levels above 16 percent (up to about 17 percent) reduced the coercivity in these hot pressed magnets, and again the X-ray diffraction patterns of the annealed ribbons revealed the presence of the 2-17 phase. Reducing the neodymium levels below 16 percent (to about 14 percent) also lowered the coercivity, but this time the decrease can be attributed to $\alpha$-Fe.

The demagnetization properties of our $Nd_{13.75+x}Fe_{80.25-x}C_6$ and $Nd_{16}Fe_{78-y}C_{6+y}$ are summarized in the following Table I.

TABLE I

The demagnetization properties of hot pressed neodymium-iron-carbon magnets. The compositions are divided into three groups by carbon levels: 6, 9 and 10 atomic percent. Neodymium levels ranged from a low of 13.75 atomic percent to a high of 17.5 atomic percent.

| Neodymium | | Iron | | Carbon | | Remanence | Coercivity | En. Product |
|---|---|---|---|---|---|---|---|---|
| at % | (wt %) | at % | (wt %) | at % | (wt %) | (kG) | (kOe) | (MGOe) |
| 13.75 | (30.3) | 80.25 | (68.6) | 6.0 | (1.1) | 7.9 | 9.0 | 11.6 |
| 14.50 | (31.7) | 79.50 | (67.2) | 6.0 | (1.1) | 6.3 | 8.6 | 4.9 |
| 15.25 | (33.0) | 78.75 | (65.9) | 6.0 | (1.1) | 4.9 | 2.8 | 1.6 |
| 16.00 | (34.3) | 78.00 | (64.7) | 6.0 | (1.1) | 3.0 | 0.2 | 0.1 |
| 13.75 | (31.0) | 77.25 | (67.4) | 9.0 | (1.7) | 6.4 | 5.2 | 5.7 |
| 14.50 | (32.3) | 76.50 | (66.0) | 9.0 | (1.7) | 7.3 | 7.8 | 9.7 |
| 15.25 | (33.6) | 75.75 | (64.7) | 9.0 | (1.7) | 7.2 | 9.2 | 10.3 |
| 16.00 | (34.9) | 75.00 | (63.5) | 9.0 | (1.6) | 7.1 | 12.0 | 10.4 |
| 16.75 | (36.2) | 74.25 | (62.2) | 9.0 | (1.6) | 4.9 | 7.5 | 2.7 |
| 17.50 | (37.5) | 73.50 | (60.9) | 9.0 | (1.6) | 3.1 | 0.7 | 0.4 |
| 13.75 | (31.2) | 76.25 | (66.9) | 10 | (1.9) | 5.9 | 1.7 | 2.2 |
| 14.50 | (32.5) | 75.50 | (65.6) | 10 | (1.9) | 7.2 | 7.9 | 9.3 |
| 15.25 | (33.9) | 74.75 | (64.3) | 10 | (1.9) | 7.1 | 8.9 | 9.8 |
| 16.00 | (35.2) | 74.00 | (63.0) | 10 | (1.8) | 6.6 | 12.3 | 8.8 |
| 16.75 | (36.5) | 73.25 | (61.7) | 10 | (1.8) | 6.7 | 13.7 | 9.0 |

Figure 4:
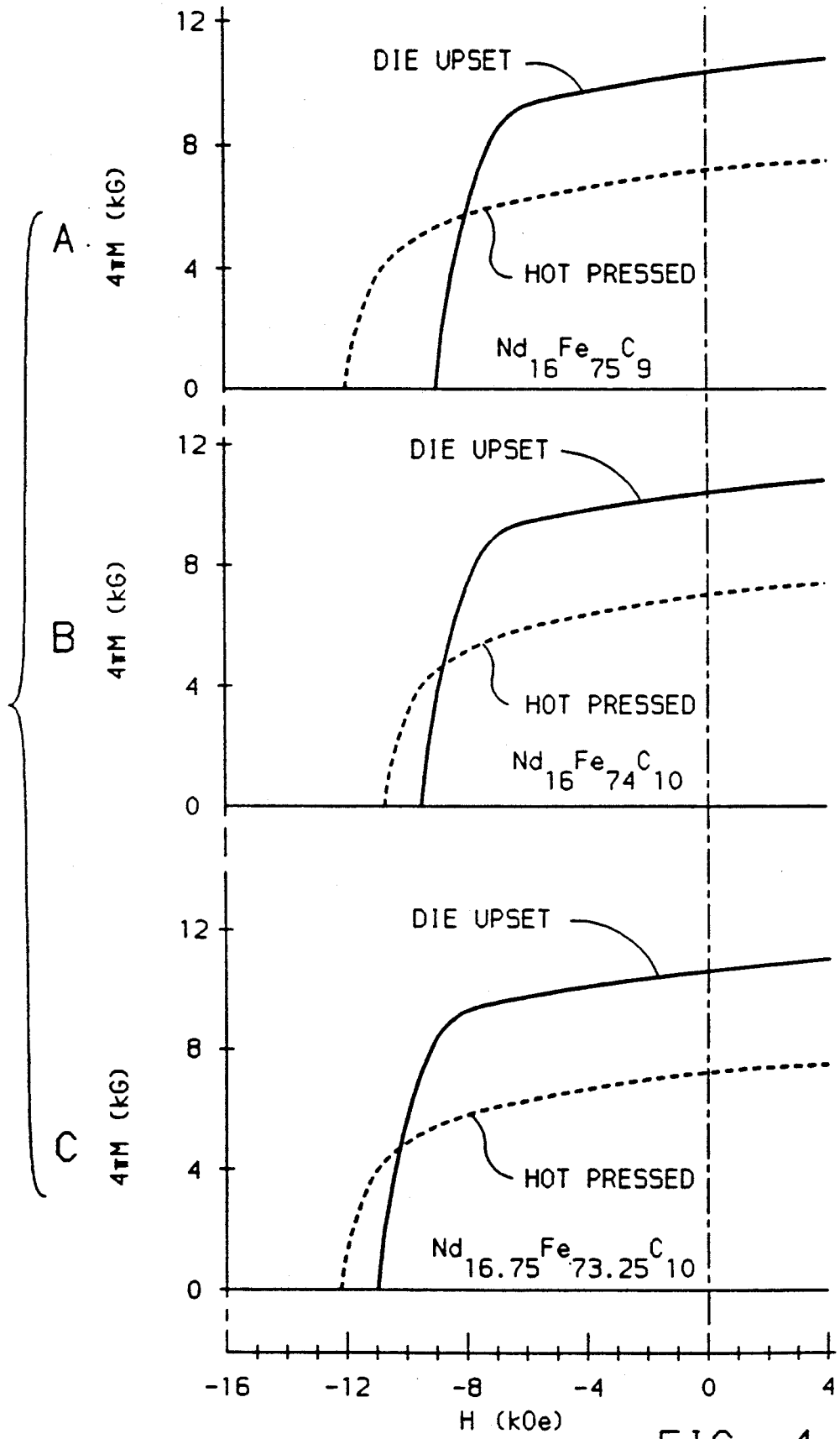

The three hot pressed magnets with the highest coercivities (≧12 kOe) were die upset using the process parameters already described (see Table II for compositions). Demagnetization curves for the three die upset magnets and their hot pressed precursors appear in FIG. 4; in each case, die upsetting increased the remanence by just over 40 percent. More importantly, the coercivity of these die upset magnets was sufficient to permit much higher energy products (about 18 MGOe to about 22 MGOe) than those observed with lower neodymium and carbon concentrations (see Example 2).

TABLE II

The demagnetization properties of die upset neodymium-iron-carbon magnets with four different compositions

| Neodymium | | Iron | | Carbon | | Remanence | Coercivity | En. Product |
|---|---|---|---|---|---|---|---|---|
| at % | (wt %) | at % | (wt %) | at % | (wt %) | (kG) | (kOe) | (MGOe) |
| 13.75 | (30.3) | 80.25 | (68.6) | 6.0 | (1.1) | 9.9 | 4.4 | 12.7 |
| 16.00 | (34.9) | 75.00 | (63.5) | 9.0 | (1.6) | 10.2 | 9.0 | 22.4 |
| 16.00 | (35.2) | 74.00 | (63.0) | 10 | (1.8) | 9.4 | 11.0 | 18.3 |
| 16.75 | (36.5) | 73.25 | (61.7) | 10 | (1.8) | 9.4 | 9.5 | 19.0 |

In accordance with the practice of our invention, rapidly solidified compositions of rare earth elements, iron (or iron and cobalt) and carbon (or carbon and boron) are hot worked to form fully densified, fine grained bodies in which the fine grains are wrought into magnetic alignment such that the body is magnetically anisotropic. By hot working we mean hot pressing, hot die upsetting, extrusion, hot isostatic compaction, rolling and the like so long as the specified resultant hot worked microstructure is attained. Generally, if the hot working practice comprises more than one step, such as the combination of hot pressing and die upsetting, all steps can be carried out without an intervening cooling step.

The compositions selected, the rapid solidification practice and the practice of rapid solidification and hot working are controlled and carried out so that the microstructure of the resultant body consists essentially of the magnetic phase $Re_2TM_{14}C_xB_{1-x}$ together with a minor portion of intergranular material. The hot working aligns the fine platelet-like grains of the principal phase such that the c-axes of the grains are aligned and the resultant body is magnetically anisotropic. The melt spun (rapidly solidified) material is preferably amorphous or suitably extremely fine grained such that the average grain size is no greater than about 40 nm. Following severe hot working, flattened grains are obtained and it is preferred that, on the average, their greatest dimension be no greater than about 1000 nm.

We prefer that the overall composition of our anisotropic magnets comprise on an atomic percent basis 50 to 90 percent iron, 6 to 20 percent neodymium and/or praseodymium, and 0.5 to 18 percent carbon or carbon and boron. Neodymium and/or praseodymium content of 13 to 17 atomic percent and a carbon content of 6 to 12 atomic percent are especially preferred. Consistent with these ranges and referring to the formula for the tetragonal crystal structure $RE_2TM_{14}C_xB_{1-x}$, RE is neodymium and/or praseodymium or mixtures of these rare earths with other rare earths provided that the other rare earths make up no more than about 40 percent of the total rare earth content, TM is iron or mixtures of iron with cobalt, and x has a value in the range of 0.2 to 1.0. Cobalt may make up about half of the TM content of the alloy.

Our hot worked, anisotropic magnets can be comminuted to an anisotropic magnetic powder for use in bonded magnets. The pulverized powder is mixed with an epoxy resin or other suitable bonding material, magnetically aligned, and pressed or molded. This resin is cured by heating, if appropriate.

While our invention has been described in terms of certain preferred embodiments thereof, it will be appreciated that other forms could readily be adapted by one skilled in the art. Accordingly, the scope of our invention is intended to be limited only by the following claims.

The embodiments of the invention in which an exclusive property or privilege is claimed are defined as follows:

1. An anisotropic permanent magnet comprising a principal phase of hot work aligned, flat, fine crystal grains of the tetragonal crystal phase $RE_2TM_{14}C_xB_{1-x}$ and an intergranular minor phase, R is one or more rare earth elements taken from the group consisting of neodymium, praseodymium or mixtures of neodymium and/or praseodymium with one or more other rare earth elements that make up no more than 40 atomic percent of the total rare earth content, TM is iron or mixtures of iron with cobalt, and where the value of x is from 0.2 to 1.0, the flat grains being on the average no greater than about 1000 nm in greatest dimension.

2. An anisotropic permanent magnet comprising, on an atomic percent basis, 50 to 90 percent iron, 6 to 20 percent neodymium and/or praseodymium and 0.5 to 18 percent carbon, and consisting essentially of a principal phase of hot work aligned, flat crystal grains of the tetragonal crystal structure $RE_2TM_{14}C_xB_{1-x}$ and an intergranular minor phase, where RE is a rare earth element, TM is iron and mixtures of iron with cobalt, and where the value of x is from 0.2 to 1.0, the grains being on the average no greater than about 1000 nm in greatest dimension.

3. An anisotropic permanent magnet as in claim 2 where x is 1 and the neodymium and/or praseodymium content is in the range of about 13 to 17 atomic percent and the carbon content is in the range of about 6 to 12 percent.

* * * * *